US007771225B1

(12) United States Patent
Wu

(10) Patent No.: US 7,771,225 B1
(45) Date of Patent: Aug. 10, 2010

(54) LOW PROFILE ELECTRONIC MODULE WITH EJECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,117

(22) Filed: Jul. 13, 2009

(51) Int. Cl.
*H01R 13/627* (2006.01)

(52) U.S. Cl. ..... 439/352; 439/372

(58) Field of Classification Search ..... 439/352, 439/372

See application file for complete search history.

(56) References Cited

U.S. PATENT DOCUMENTS 6,749,448 B2 6/2004 Bright et al.
6,758,699 B1 * 7/2004 Hwang et al. ..... 439/676
6,786,653 B1 * 9/2004 Hwang et al. ..... 439/358
6,824,416 B2 11/2004 Di Mascio
6,851,867 B2 2/2005 Pang et al.
6,884,097 B2 4/2005 Ice
6,908,323 B2 6/2005 Ice
7,052,306 B2 5/2006 Ishigami et al.
7,064,959 B2 6/2006 Kim
7,077,578 B2 7/2006 Lee et al.
7,077,686 B2 7/2006 Seo et al.
7,090,523 B2 8/2006 Shirk et al.
7,114,984 B2 * 10/2006 Shirk et al. ..... 439/372

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electronic module (100) includes a housing having a body portion and a mounting portion extending rearward from the body portion, a printed circuit board (3) accommodated in the housing, a cable (4) terminated to a rear portion of the printed circuit board and an ejector. The ejector includes a slider (61) slidably mounted to a channel defined in the mounting portion; an actuator (62) including a transversal beam across the mounting portion and two legs connected to opposite ends of the transversal beam and disposed outward of lateral sides of the mounting portion, said legs pivotally engaged with the mounting portion of the housing and linked to the slider; a pulling member (64) connected to the transversal beam of the actuator, with a tie (644) attached to the pulling member and wrapping the cable.

20 Claims, 6 Drawing Sheets

LOW PROFILE ELECTRONIC MODULE WITH EJECTOR

CROSS-REFERENCE TO RELATED APPLICATION

This application is related to U.S. patent application Ser. No. 12/287,966 filed on Oct. 14, 2008 and entitled "ELECTRONIC MODULE WITH EJECTOR", which has the same applicant and assignee as the present invention. The disclosure of the related application is incorporated herein by reference.

BACKGROUND OF THE INVENTION

1. Field of the Invention

The present invention generally relates to an electronic module, and more particularly to a low profile and easily manipulated electronic module.

2. Description of Related Art

SFP (Small Form-factor Pluggable), X-SFP and QSFP are all modules for fiber optic transmission or ordinary signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle.

When such a module embedded in a system fails, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it. Additionally, a user should not attempt to pull on cables of the module in order to try and remove a failed module or else the user might cause damage thereto.

A typical release method for a pluggable module is to push in on the module itself and then pull out on the module to release it from a cage assembly or module receptacle. It has been determined than this method is not very reliable with users complaining of the difficulty in removing pluggable modules in such manner. Users often complain that traditional methods offer little leverage in getting a sufficient grip on the module when attempting to pull it out of a module receptacle. Another complaint is that traditional actuators used to remove modules are inaccessible or invisible. Other users complain than once released by the traditional method, it is difficult to withdraw the module out of its cage or module receptacle.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above.

However, ejectors of the aforementioned patents are not low enough and may increase height of the electronic module.

Furthermore, the more low profile of the electronic module, the more difficult for a user to operate the ejector.

SUMMARY OF THE INVENTION

Accordingly, an object of the present invention is to provide an electronic module having an improved ejector.

In order to achieve the object set forth, an electronic module in accordance with the present invention comprises a housing having a body portion and a mounting portion extending rearward from the body portion; a printed circuit board accommodated in the housing; a cable terminated to a rear portion of the printed circuit board; and an ejector. The ejector includes a slider slidably mounted to a channel defined in the mounting portion; an actuator including a transversal beam across the mounting portion and two legs connected to opposite ends of the transversal beam and disposed outward of lateral sides of the mounting portion, said legs pivotally engaged with the mounting portion of the housing and linked to the slider; a pulling member connected to the transversal beam of the actuator, with a tie attached to the pulling member and wrapping the cable.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
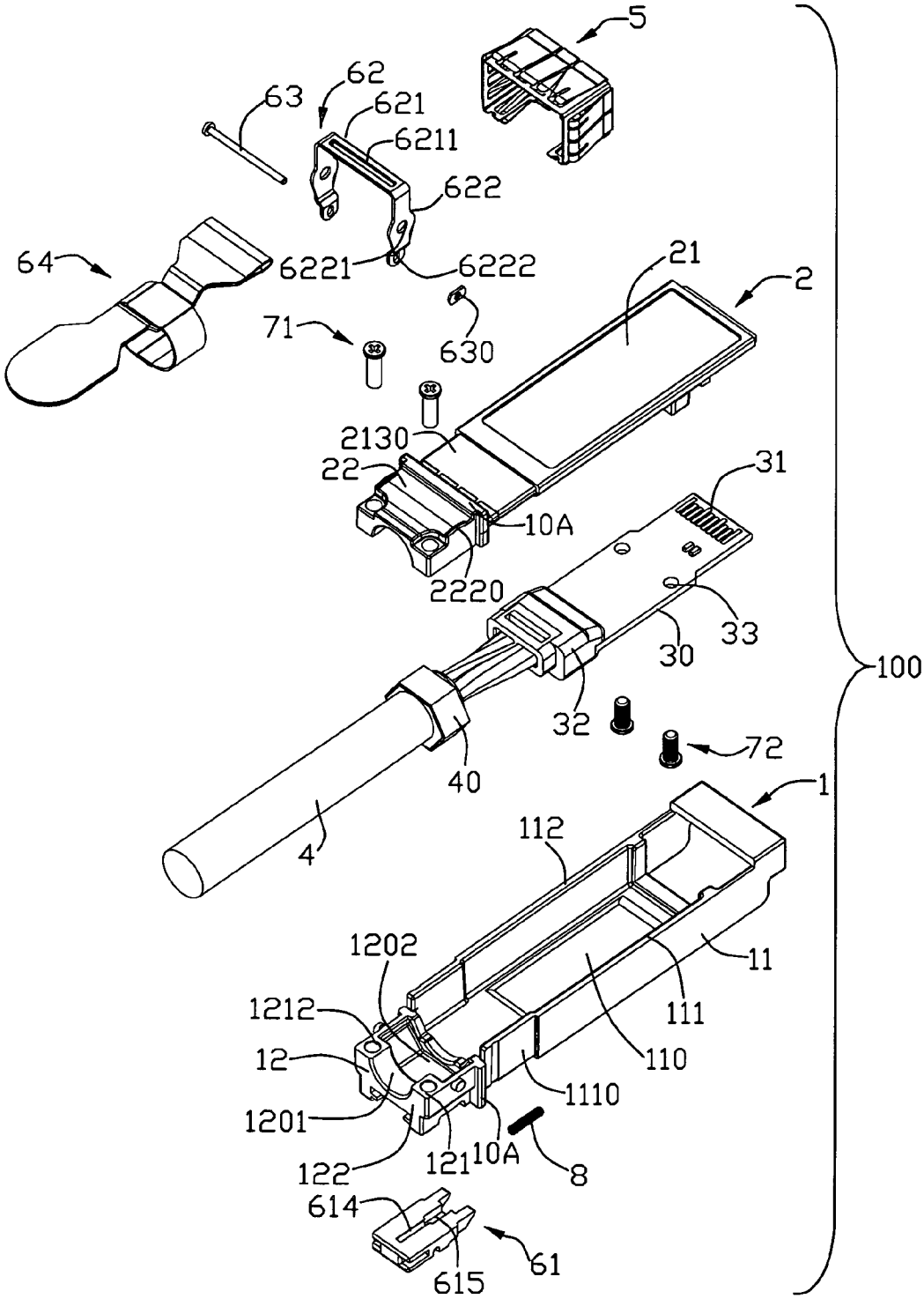
FIG. 1 is an exploded, perspective view of an electronic module in accordance with the present invention.
Figure 2:
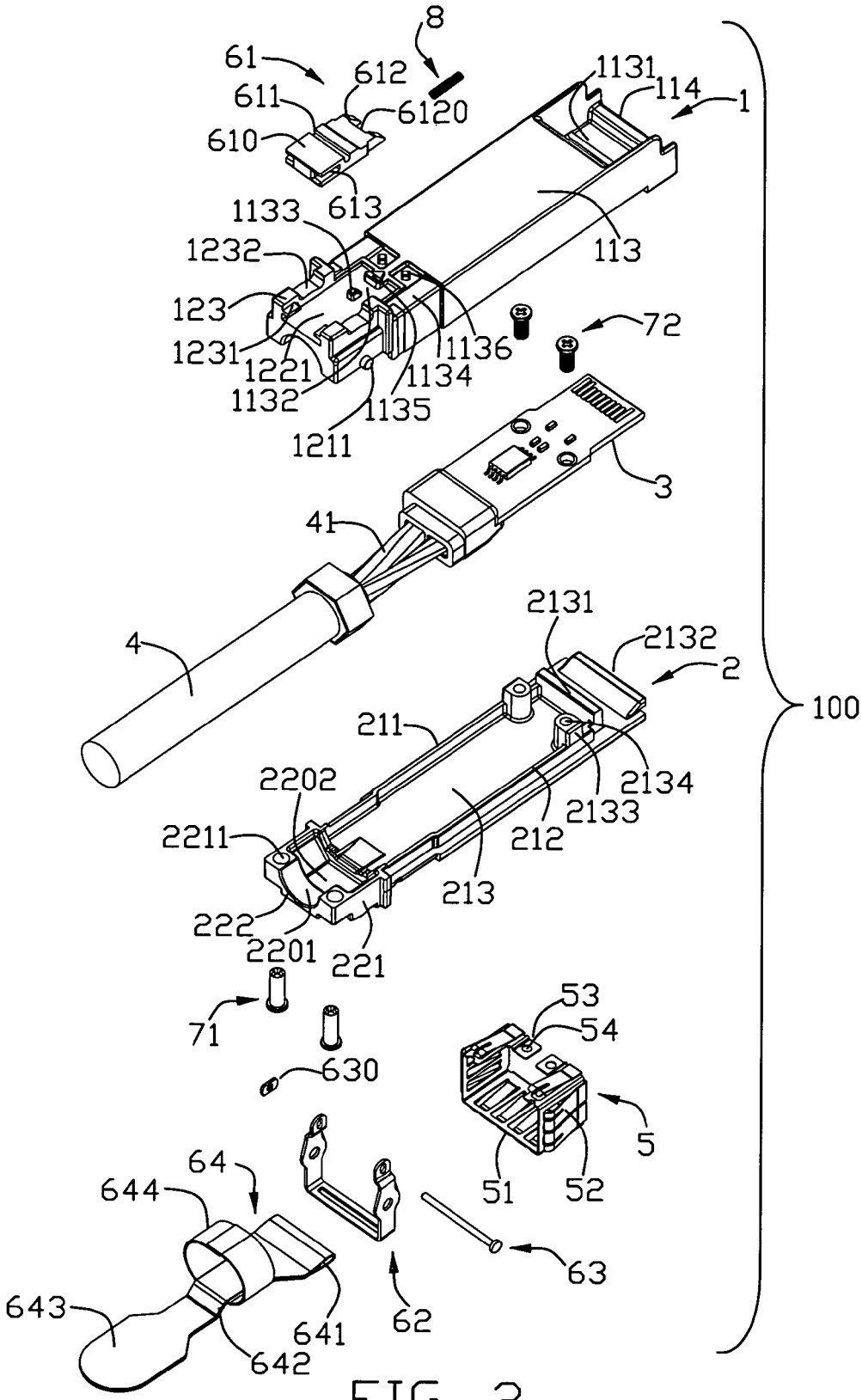
FIG. 2 is a view similar to FIG. 1, but viewed from another aspect.
Figure 3:
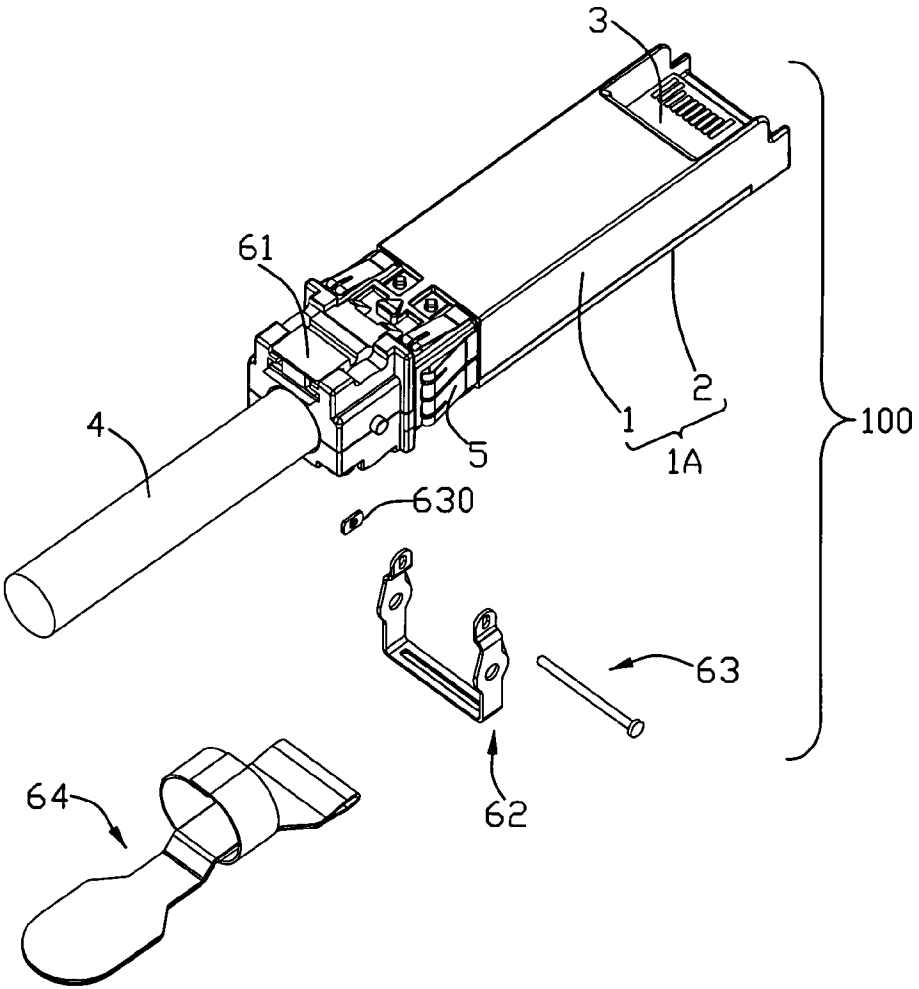
FIG. 3 is a partially assembled, perspective view of the electronic module.
Figure 4:
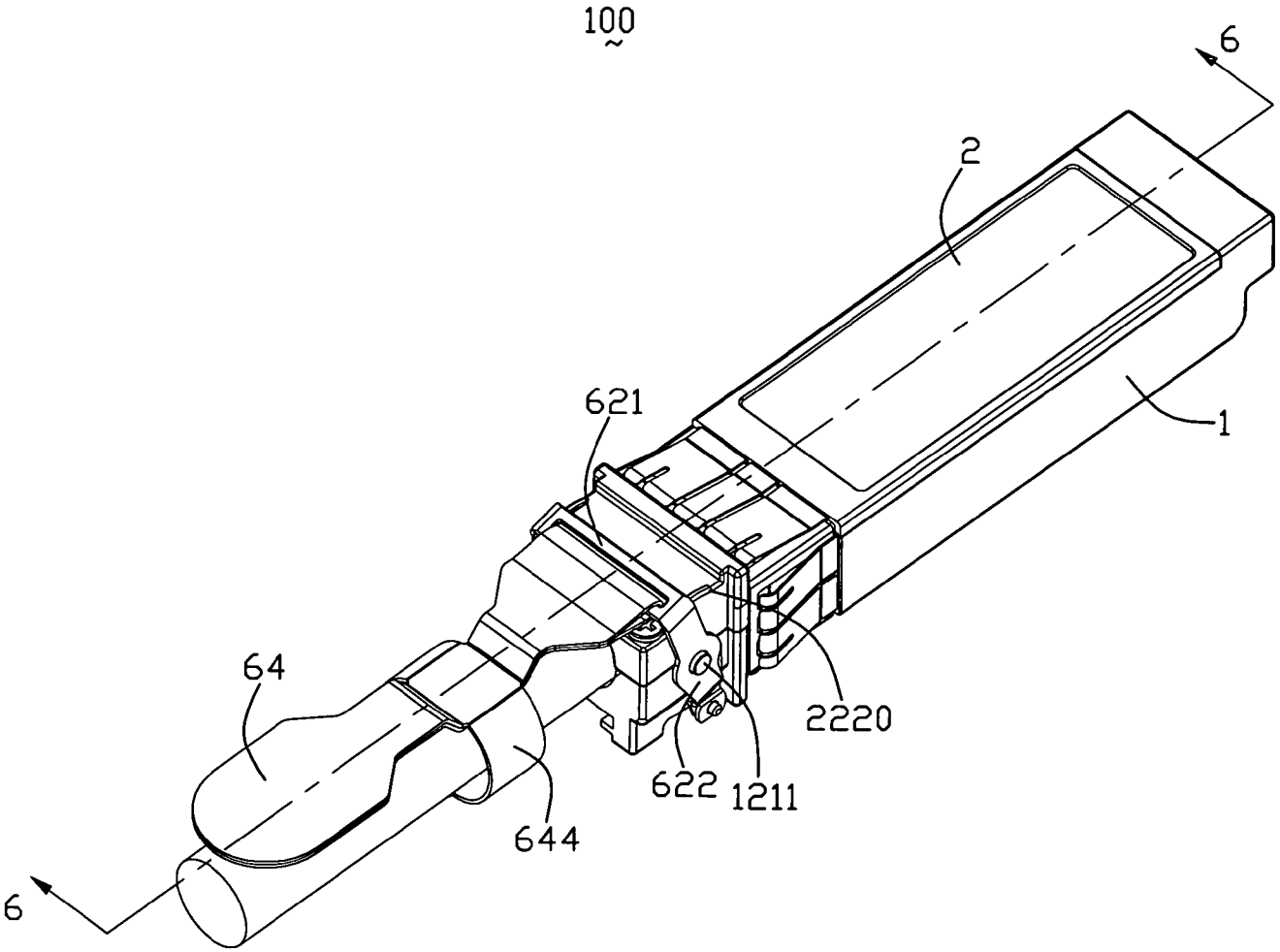
FIG. 4 is an assembled, perspective view of the electronic module.
Figure 5:
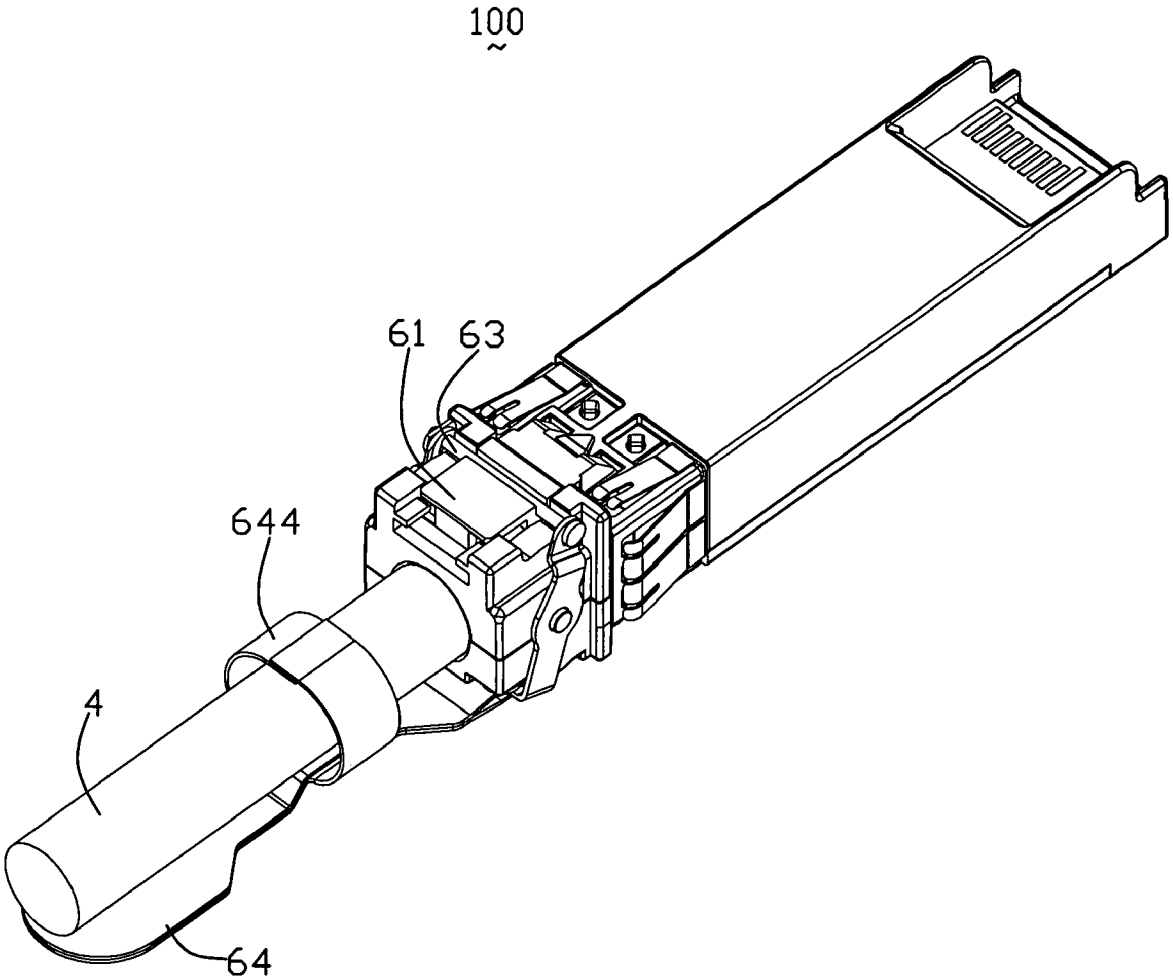
FIG. 5 is a view similar to FIG. 4, but viewed from other aspect.
Figure 6:
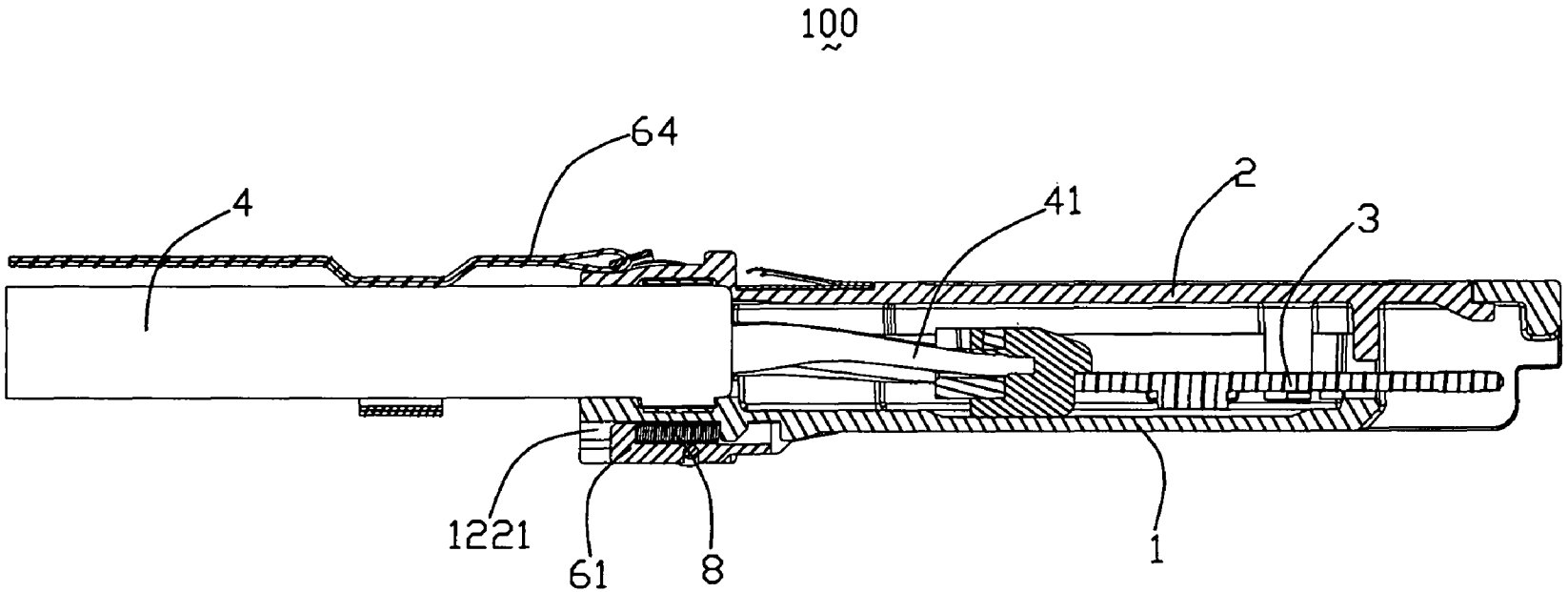
FIG. 6 is a cross-section view taken along line 6-6 of FIG. 4.

Referring to FIGS. 1-6, an electronic module 100 comprises an elongated housing 1A, a printed circuit board (PCB) 3 enclosed in the housing 1A, a cable 4 terminated to the PCB 3, a metal gasket 5 mounted to a rear segment of the housing 1A and an ejector assembled to the housing 1A for separating the electronic module 100 from a complementary connector (not shown). The elongated housing 1A has a flange 10A which is formed on peripheral of the housing 1A to divided the housing into a longer body portion and a shorter mounting portion. The flange 10A also serves as mating stopper.

The housing 1A includes a base 1 and a cover 2. The base 1 is die-cast or other metal plated body, including a primary body portion 11 and a first mounting portion 12 rearward extending from back segment of the primary body portion 11. The primary body portion 11 has a pair of lateral walls 111, 112 and a bottom wall 113 joining to lower sections of the two lateral walls 111, 112 to from a receiving space 110 with an upper window (not numbered). Rear sections of the pair of the lateral walls 111, 112 define a pair of first depression portions 1110. A front section of the bottom wall 113 is cut to form an outlet 1131. A rear section of the bottom wall 113 defines a first channel 1132 located in a middle area thereof, with a locking tab 1135 formed in the front and middle therein. A pair of L-shaped depression portions 1134 are defined in two lateral areas of the rear section of the bottom wall 113, disposed outward of the first channel 1132. A pair of tiny posts 1136 are respectively arranged in the pair of L-shaped depression portions 1134 and adjacent to each other. The primary body portion 11 further has beam portion 114 with substantially L-shaped cross-section interconnecting distal portions of the pair of the lateral walls 111, 112.

The first mounting portion 12 has a pair of side walls 121 and a lower wall 122 to corporately form a first semi-circular cavity 1201 and a deeper first position slot 1202 located in front of the first semi-circular cavity 1201. A second channel 1221 is defined in a middle area of the lower wall 122 and communicates with the first channel 1132 of the primary body portion 11. A stopping member 1133 is located in a front portion of the second channel 1221 and aligns with the locking tab 1135 along a front-to-back direction. A pair of guiding members 123 are respectively formed on lateral areas of the lower wall 122. A thin bar member 1231 projects inwardly from an inner surface of a rear portion of each guiding member 123. A lengthways guiding groove 1232 is located in a middle segment of each guiding member 123 and disposed in front of the bar member 1231. A pair of pivot members 1211 are respectively formed on upper sections of the outer surfaces of the pair of side walls 121. A pair of screw holes 1212 are respectively recessed downward from up surfaces of rear sections of the side walls 121.

The cover 2 is a die-cast or metal plated body, including a secondary body portion 21 and a second mounting portion 22 rearward extending from back segment of the secondary body portion 21. The secondary body portion 21 has a planar board member 213 and a pair of flange members 211, 212 formed at lateral sides of the board member 213. A second depression portion 2130 is defined in a peripheral portion of a rear portion of the board member 213. A vertical wall 2131 is arranged on an inner side of the front section of the board member 213. A pair of supporting posts 2133 are located behind the vertical wall 2131, and each supporting post 2133 further defines a second screw hole 2134 therein. A protrusion portion 2132 extends forwardly form inner surface of a front portion of the board member 213.

The cover 2 further includes a second mounting portion 22 rearward extending from a back face of the secondary body portion 21. The second mounting portion 22 also has a pair of side walls 221 and a top wall 222 to corporately form a second semi-circular cavity 2201 and a deeper second position slot 2202 located in front of the second semi-circular cavity 2201. A pair of through holes 2211 are respectively defined in a rear section of the side walls 221. Two protrusions 2220 are respectively formed at lateral sides of a top surface of the top wall 222. Each protrusion 2220 has an arched up side.

The ejector includes a slider 61, an actuator 62, and a pulling member 64.

The slider 61 has a substantially rectangular shaped body portion 610 and two wedge-shaped tabs 612 extending forwardly from the body portion 610. The two tabs 612 space from each other, with a passage 6120 formed therebetween. A cavity 611 is recessed downwardly from an upper surface of a middle segment of the body portion 610, and two grooves 613 respectively recessed inward from lateral surfaces of a rear segment of the body portion 610. A circular shaped first slot 614 is recessed upwardly from a bottom surface of a rear portion of the slider 61, and a rectangular shape second slot 615 is recessed upwardly from a bottom surface of a front portion of the slider 61. The first slot 614 is in communication to the second slot 615. Furthermore, the second slot 615 is larger than the first slot 614. A rear segment of a spring member 8 is accommodated in the first slot 614, and a front segment of the spring member 8 projects into the second slot 615.

The actuator 62 is configured to doorframe-shaped, including a doorhead or transversal beam 621 and two door jambs or leg portions 622 connected to ends of the doorhead 621. A pair of first positioning holes 6221 are respectively defined in middle sections of the leg portions 622, and a pair of mounting holes 6222 are respectively defined through the lower ends thereof. A slot 6221 is defined in the transversal beam 621.

The pulling member 64 includes an engaging portion 641, a pulling portion 643 and a connecting portion 642 connected with the engaging portion 641 and the pulling portion 643. A tie 644 is attached to the connecting portion 642. However, it should be known that the tie may be integrally formed with the connecting portion 642. The engaging portion 641 is linked to the slot 6221 of the transversal beam 621.

The metal gasket 5 includes a number of walls 51 interconnected together to form a frame, and a plurality of spring tabs 52 formed on outer sides of the walls 51. Two clasping portions 53 are connected to ends of the frame and face to each other, and each clasping portion 53 defines a hole 54.

The PCB 3 includes a substrate 30, a plurality of first conductive pads 31 arranged on a front section of the substrate 30 to form a mating interface. A pair of positioning holes 33 are defined in the substrate 30, proximate a front section thereof.

The cable 4 includes a number of wires 41 terminated to a rear segment of the PCB 3. An insulator 32 is molded over the rear segment of the PCB 3 and portions of the wires 41 to enhance engagement between the wires 41 and the PCB 3. An asymmetrical hexagon ring 40 is crimped onto the cable 4 and accommodated in a position slot 1202, 2202 of the first and second mounting portions 12, 22. Such asymmetrical hexagon ring 40 may well match with the position slot 1202, 2202, as the position slot 1202 is larger than the position slot 2202.

When assembling, the PCB 3 is put on the pair of supporting posts 2133 of the cover 2, with the pair of positioning holes 33 thereof aligning with the pair of second screw holes 2134 of the pair of supporting posts 2133, and then a pair of second screw members 72 are inserted into the pair of positioning holes 33 and the pair of second screw holes 2134 to fix the PCB 3 to the cover 2. The cover 2 is assembled to the base 1, with a pair of lateral flange members 211, 212 thereof inserted into the receiving space 110, the protrusion portion 2132 supported by the beam portion 114 of the base 1, Simultaneously, the PCB 3 is received in the receiving space 110, the pair of through holes 2211 of the cover 2 aligning with a pair of screw holes 1212 of the base 1, then a pair of first screw members 71 are inserted into the through holes 2211 and screw holes 1212 to fasten the cover 2 and the base 1 together.

The gasket 5 is assembled to an outer surface of the housing, with the walls 51 located in the a pair of first depression portions 1110 of the base 1 and the second depression portions 2130 of the cover 2, the clasping portions 53 located in the pair of L-shaped depression portions 1134, the pair of tiny posts 1136 within the depression portions 1134 inserted into a pair of through holes 54 of the pair of mounting members 54 and then soldered thereto.

The slider 61 is assembled to the second channel 1221 of the first mounting portion 12, with the pair of thin bar members 1231 of the two guiding members 123 received in the two grooves 613 thereof, the cavity 611 aligning with guiding grooves 1232 of the two guiding members 123, the stopping member 1133 accommodated in the second slot 615 to prevent the spring member 8 sliding away the slider 61, the passage 6120 between the tabs 612 facing to the locking tab 1135 in the first channel 1132.

Then, the pulling member 64 is linked to the transversal beam 621 of the actuator 62. The actuator 62 is assembled to the first mounting portion 12 of the base 1, with the pair of pivot members 1211 of the first mounting portion received in the pair of first positioning holes 6221 of the legs 622 of the actuator 62, the pair of mounting holes 6222 located in the end section of the legs 622 aligning with the cavity 611 and the guiding grooves 1232 of the two guiding members 123, then a bolt 63 is inserted through the pair of mounting holes 6222, the cavity 611 and the guiding grooves 1232, and a corresponding nut 630 is assembled to the bolt 63. The transversal beam 621 is located above and proximate to the protrusions 2220 of the a second mounting portion 22. The tie 644 is wrapped the cable 4 to hang the pulling member 6.

While the electronic module 100 disengages away the complementary connector, just exert a pulling force on the pulling portion 643 to rock the actuator 62 rotating around the pivot members 1211, such that the slider 61 is pushed moving forwardly along the second channel 1221 and the first channel 1132 to urge latch mechanism of the complementary connector deflecting from the locking tab 35, such that the electronic module 100 is separated from the complementary connector. Then the spring member 8 pushes the slider 61 moving rearward to return its original position. The transversal beam 621 is always proximate to the protrusions 2220 at every position, which may prevent the two legs 622 disengaging away the pivot members 1211, while the doorhead is pressed excessively. Furthermore, the pulling member 64 is always disposed adjacent to the cable 4, even the electronic module 100 is disposed upside down. Thus, the electronic module 100 may occupy less space. Especially, when two or more electronic modules are arranged in stacked manner, the pulling member 64 is no longer an obstacle to prevent plugging the electronic module.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electronic module, comprising:

a housing having a body portion and a mounting portion extending rearward from the body portion;

a printed circuit board accommodated in the housing;

a cable terminated to a rear portion of the printed circuit board; and an ejector including:

a slider slidably mounted to a channel defined in the mounting portion;

an actuator including a transversal beam across the mounting portion and two legs connected to opposite ends of the transversal beam and disposed outward of lateral sides of the mounting portion, said legs pivotally engaged with the mounting portion of the housing and linked to the slider;

a pulling member connected to the transversal beam of the actuator, with a tie attached to the pulling member and wrapping the cable.

2. The electronic module as claimed in claim 1, wherein the pulling member includes an engaging portion, a pulling portion and a connecting portion connected with the engaging portion and the pulling portion.

3. The electronic module as claimed in claim 2, wherein the engaging portion is connected to the transversal beam of the actuator.

4. The electronic module as claimed in claim 2, wherein the tie is attached to the connecting portion of the pulling member.

5. The electronic module as claimed in claim 4, wherein two protrusions are respectively formed at lateral sides of a top surface of the mounting portion, and the two protrusions are located below the transversal beam of the actuator.

6. The electronic module as claimed in claim 5, wherein each of the two protrusions has an arched top side.

7. The electronic module as claimed in claim 1, wherein a spring member is arranged between the slider and the mounting portion and capable of pushing the slider rearward along the channel.

8. The electronic module as claimed in claim 7, wherein a stopping member is located in a front portion of the channel and a slot is defined in a low section of the slider, and wherein the spring member is confined in the slot by the stopping member.

9. The electronic module as claimed in claim 8, wherein the slot includes a first slot and a second slot, and the second slot is larger than the first slot.

10. The electronic module as claimed in claim 9, wherein a rear portion of the spring member is located in the first slot and a front portion of the spring member extends into the second slot.

11. The electronic module as claimed in claim 9, wherein the stopping member is movable into the second slot.

12. The electronic module as claimed in claim 1, wherein two guiding members are arranged at lateral sides of the channel, and each guiding member has a guiding groove recessed downwardly from a top surface thereof.

13. The electronic module as claimed in claim 12, wherein a cavity is defined in an upper portion of the slider and aligns with the guiding groove of each guiding member.

14. The electronic module as claimed in claim 13, wherein a bolt links free ends of the two leg portions of the actuator and passes through the guiding grooves of the guiding members and the cavity of the slider.

15. The electronic module as claimed in claim 1, wherein two pivot members are formed on lateral sides of the mounting portion and inserted into positioning holes defined in the two leg portions of the actuator.

16. The electronic module as claimed in claim 1, wherein an insulator is overmolded onto the rear portion of the printed circuit board and partial of the cable adjacent thereto.

17. The electronic module as claimed in claim 1, wherein an asymmetrical hexagon ring is crimped onto the cable and accommodated in a position slot defined in an interior of the mounting portion of the housing.

18. An electrical module assembly comprising:

a housing having a body portion and a mounting portion behind the body portion;

a mating port defined in a front portion of the body portion;

a cable extending rearwardly from a mounting portion;

a locking tab formed on the mounting portion;

an ejector assembled to the mounting portion and including:

a slider horizontally moveable relative to the mounting portion for disengaging complementary part from the locking tab;

an actuator pivotally mounted to the mounting portion about a pivot and including opposite first and second ends by two sides of said pivot, said slider being positioned at the first end; and a pulling member positioned at the second end under condition that rearward movement of the pulling member results in forward movement of the slider; wherein said pulling member is equipped with a band section surrounding the cable so as to assure said pulling member is constantly intimately associated with the cable disregarding whether said pulling member is in use or not.

19. An electrical module assembly comprising:

a housing having a body portion and a mounting portion behind the body portion;

a mating port defined in a front portion of the body portion;

a cable extending rearwardly from a mounting portion;

a locking tab formed on the mounting portion;

an ejector assembled to the mounting portion and including:

a slider horizontally moveable relative to the mounting portion for disengaging complementary part from the locking tab;

one of the slider and the mounting portion defining a bar member and the other defining a groove receiving said bar member so as to assure horizontal movement of the slider relative to the mounting portion;

a spring located and hidden between the slider and a stopping member formed on the mounting portion so as to provide a biasing force to urge the slider rearwardly;

an actuator pivotally mounted to the mounting portion about a pivot and including opposite first and second ends by two sides of said pivot, said slider being positioned at the first end; and a pulling member positioned at the second end under condition that rearward movement of the pulling member results in forward movement of the slider; wherein the slider forms a cavity in an exterior face to receive a bolt which is linked to first end of the actuator.

20. The electronic module assembly as claimed in claim 19, wherein the bar member and the groove are located behind the cavity.

* * * * *